US007399047B2

(12) United States Patent
Ward et al.

(10) Patent No.: US 7,399,047 B2
(45) Date of Patent: Jul. 15, 2008

(54) CONSUMABLE CARTRIDGE WITH THEFT DETERRENCE FEATURES

(75) Inventors: Jefferson P Ward, Brush Prairie, WA (US); Mark D Lund, Vancouver, WA (US); Steven T. Castle, Philomath, OR (US); Erik D Ness, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 266 days.

(21) Appl. No.: 10/834,450

(22) Filed: Apr. 29, 2004

(65) Prior Publication Data

US 2005/0243116 A1 Nov. 3, 2005

(51) Int. Cl.
*B41J 29/393* (2006.01)
*B41J 2/175* (2006.01)

(52) U.S. Cl. ..... 347/19; 347/86

(58) Field of Classification Search ..... 347/19
See application file for complete search history.

(56) References Cited

U.S. PATENT DOCUMENTS 6,351,618 B1 * 2/2002 Pollocks, Jr. ..... 399/12
6,447,090 B1 * 9/2002 Saruta ..... 347/19
2001/0019343 A1 * 9/2001 Walker et al. ..... 347/19
2003/0035129 A1 2/2003 Phillips
2003/0063147 A1 4/2003 Walker
2005/0097385 A1 * 5/2005 Ahne et al. ..... 714/2

FOREIGN PATENT DOCUMENTS

EP 0812693 12/1997
EP 1190859 3/2002
EP 1190859 A2 * 3/2002 ..... 347/93
WO WO 02/061578 8/2002

OTHER PUBLICATIONS

International Search Report dated Aug. 16, 2005.

* cited by examiner

*Primary Examiner*—Matthew Luu
*Assistant Examiner*—Jannelle M Lebron

(57) ABSTRACT

Embodiments of the invention involve modifying non-volatile data fields in the integral memory components of consumable cartridges (and, in some embodiments, data fields in the utilizing device memory) such that the consumable cartridges become compatible with only a small subset of utilizing devices, thereby substantially reducing their potential value to a thief or unauthorized borrower.

13 Claims, 8 Drawing Sheets

CONSUMABLE CARTRIDGE WITH THEFT DETERRENCE FEATURES

RELATED APPLICATIONS

This application is related to the copending U.S. Application of Jefferson P. Ward, et. al. entitled "CONSUMABLE CARTRIDGE THEFT DETERRENT METHOD APPARATUS AND METHODS", Ser. No. 10/834,946 filed on the same date as the present application.

FIELD OF INVENTION

This invention relates generally to containers for consumable substances, and more particularly to replaceable containers having integral electronic memory devices.

BACKGROUND OF THE INVENTION

Many types of equipment, apparatus, or devices require a supply of a consumable substance. The substance may be needed for the equipment to operate properly, such as a fuel or lubricant; or the substance may be utilized by the equipment as a component or ingredient in forming a final product or output. Consumable substances may be provided in replaceable containers that are changed when the substance is depleted.

Printers with user-replaceable consumables (and related devices, such as facsimile machines and copiers) are well known in the art. For example, inkjet printers typically utilize replaceable ink supplies, either integrated with a printhead or in the form of separate supplies. In laser printers, toner is typically supplied in a replaceable cartridge, which may include the photosensitive drum on which images are formed.

It is increasingly common for containers of consumable substances to have integral electronic memory devices, which may be used for a variety of purposes by the utilizing equipment. The memory device may be used as a "keying" feature to differentiate between different substances, may contain calibration information, or may be used to indicate a status condition of the consumable, such as the substance level within the container. The memory devices may also be used for many other purposes, such as enabling specialized features of the utilizing device or providing other value to the equipment user. While earlier memory devices typically had electrical contacts that had to connect to mating contacts in the utilizing equipment, newer devices are often wireless and rely on radio frequency (RF) communication.

Replaceable printer consumables, such as inkjet cartridges, tend to be both relatively small and moderately costly to replace. The small size and relatively high cost can make the consumables tempting targets for theft, which tends to discourage the placement of printers in public or semi-public places, such as libraries, schools, restaurants, coffee shops, and hotels. The cartridges in an unattended printer are prone to be appropriated for use in another printer, such as in home computer system.

Even in more private and secure settings, such as office environments and homes, printer consumables have a tendency to "disappear", since it can be more convenient to "borrow" a consumable from an unattended printer than to acquire a replacement consumable through appropriate channels.

Misappropriation of a cartridge of a consumable substance can result in expensive "downtime" of the utilizing equipment; replacing the cartridge can add significant additional costs, as well as being an inconvenience to the user.

SUMMARY OF THE INVENTION

Embodiments of the present invention include cartridges of consumable substances having integral electronic memory devices that are configured to be programmed by the user in a manner that essentially renders the cartridges usable only on specific individual units of utilizing equipment, thus reducing the potential for theft or misappropriation. Embodiments also include utilizing equipment configured to interact with such consumables, and methods.

Other aspects and advantages of the present invention will become apparent from the following detailed description, taken in conjunction with the accompanying drawings, illustrating by way of example the principles of the invention.

BRIEF DESCRIPTION OF THE DRAWINGS

FIG. 7(*b*) is a flowchart illustrating the "encode TD information" steps for an exemplary embodiment of the invention;

FIG. 8(*b*) is a flowchart illustrating the "encode TD information" steps for a further exemplary embodiment of the invention.

DESCRIPTION OF THE EMBODIMENTS OF THE INVENTION

Embodiments of the invention are described with respect to an exemplary inkjet printing system and printing consumable; however, the invention is not limited to the exemplary inkjet system and consumable, but may also be utilized in other systems having replaceable consumables.

Figure 1:
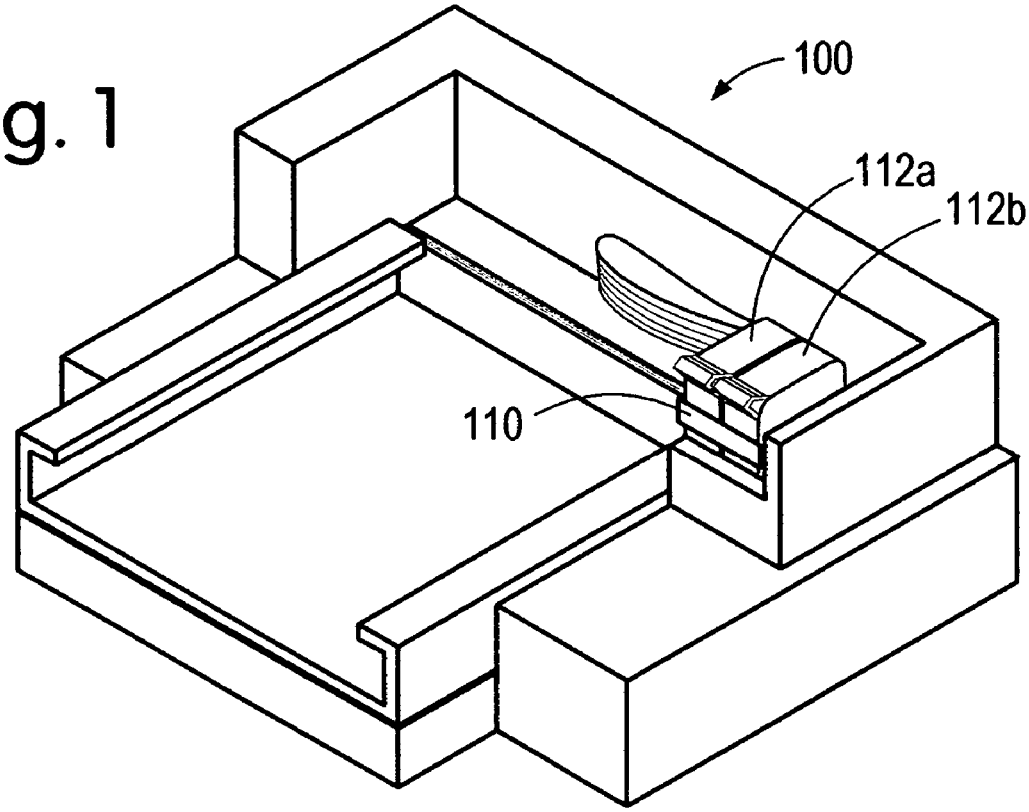
FIG. 1 depicts an exemplary printing device in which embodiments of the present invention may be utilized.

FIG. 1 illustrates an exemplary printing system 100 in which embodiments of the present invention may be used. As shown in FIG. 1, one or more containers or cartridges 112*a*, 112*b* may typically be installed in a receiving station 110 of a printer. The cartridges are typically replaced when the contained supply of a consumable substance, which may be a marking material such as toner or ink, is depleted. The receiving station 110 may comprise a scanning carnage which is scanned across print media as ink or other fluids are deposited on the media; or the receiving station may alternatively be separate from the scanning carriage (an "off axis" printer). In other printing systems, other marking materials may be provided by the replaceable cartridges, such as toner in laser printers.

Figure 2:
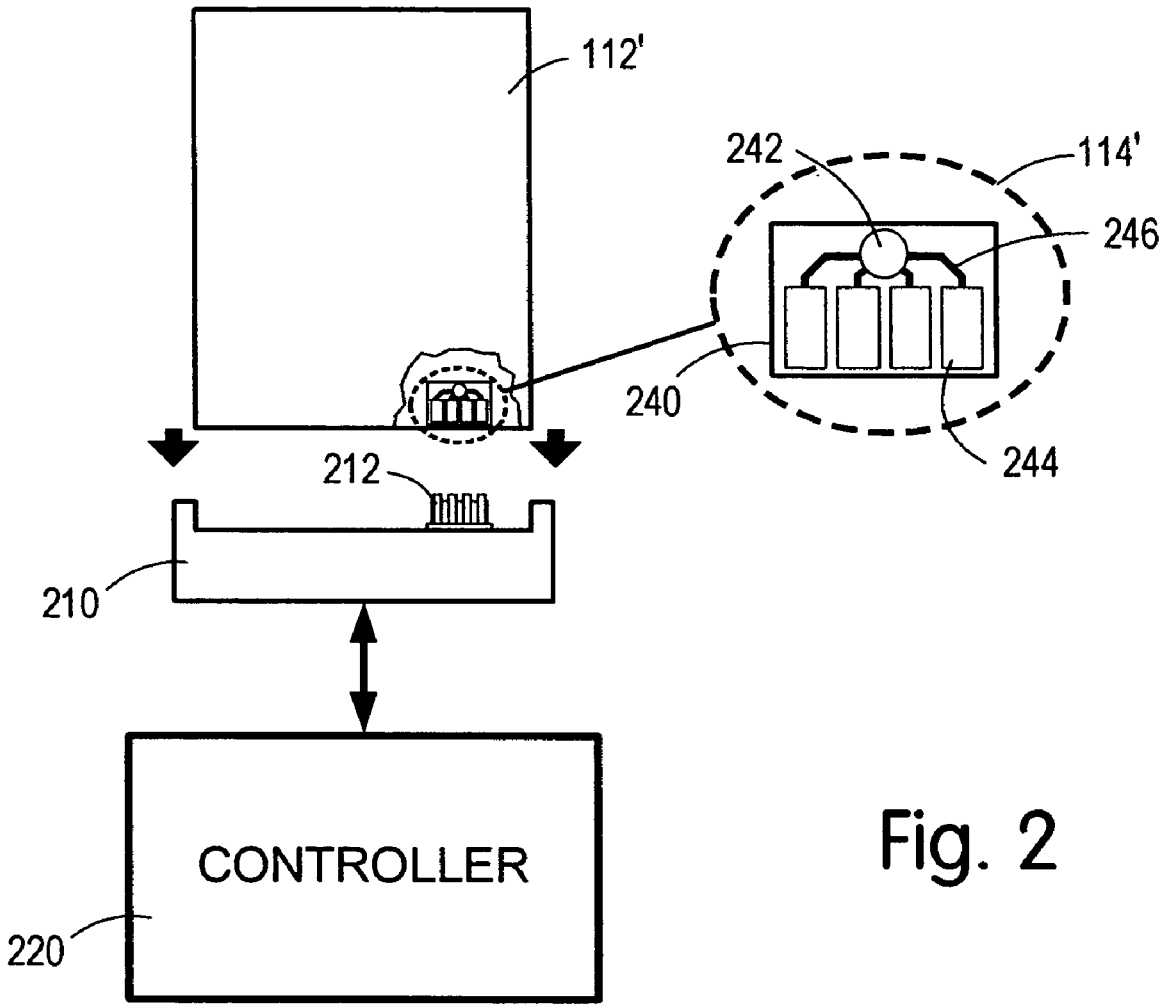
FIG. 2 illustrates one exemplary embodiment of a consumable item, such as an inkjet cartridge, with an integral memory component.

FIG. 2 illustrates one exemplary embodiment of a consumable cartridge 112', such as an inkjet cartridge, with an integral memory component 114'. In the embodiment of FIG. 2, the memory component includes electrical contacts for mating with an external electrical connector. The memory component 114' is formed as a small printed circuit assembly 240, with a plurality of printed electrical contacts 244 for mating with an external connector 212. Printed wiring 246 on the printed circuit assembly provides electrical communication between the electrical contacts and integrated circuit memory 242, which in the exemplary embodiment is encapsulated in a protective material such as epoxy.

The integrated circuit memory 242 of the exemplary embodiment is typically a serial input/output memory, as are well known in the art. Such memories may have an asynchronous serial data interface, requiring only a single electrical data lead, plus a case ground return, for data input and output. Data input and output from the one wire memory is accomplished via a protocol wherin various length pulses are employed which evidence the beginning of a read/write action. Those pulses are followed by bit-by-bit transfers, wherein ones and zeros are manifest by different pulse lengths. Alternatively, the memories may have a synchronous serial interface including a clock line. Other serial input/output memories may also be employed for the present invention, as well as other, non-serial memory configurations.

U.S. Pat. No. 5,699,091 entitled "Replaceable Part With Integral Memory For Usage, Calibration And Other Data" assigned to the assignee of the present invention, further describes the use and operation of such a memory device. As described in the 5,699,091 patent, the memory device may be utilized to allow a printer to access replaceable part parameters to insure high print quality. In addition to allowing the printer to optimize print quality, the memory may be used to prevent inadvertent damage to the printer resulting from improper operation, such as operating after the supply of ink is exhausted or operating with the wrong or non-compatible printer components.

When installed by the consumer, the consumable item 112' with the memory component 114' is mated to a receiving station 210, such as on the carriage of an inkjet printer, which includes mating electrical contacts 212. The consumable item and receiving station may include other interconnections, such as other electrical connections or fluid connections. The receiving station in turn is in data communication with a controller 220, which allows reading of the data in the memory component, such as by the printer firmware.

Figure 3:
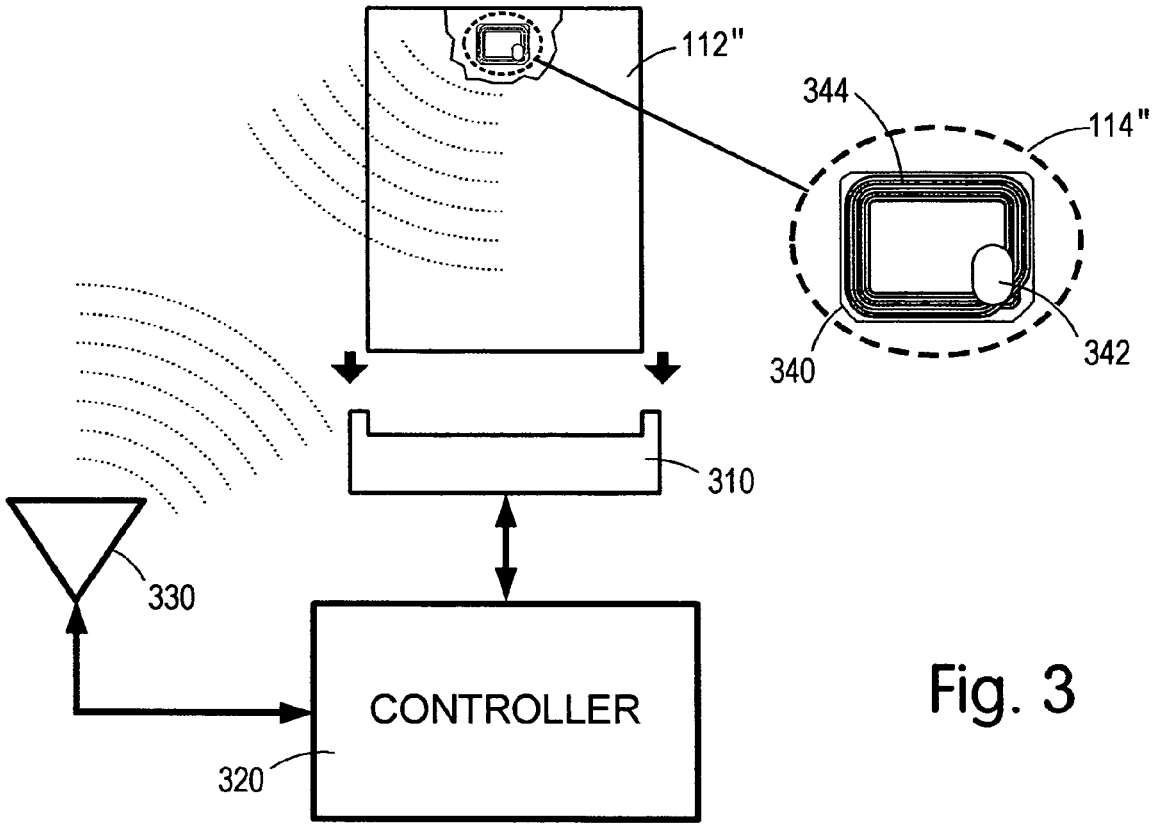
FIG. 3 illustrates a second exemplary embodiment of a consumable item, such as an inkjet cartridge, in which a wireless data link is used for communicating with the memory component.

FIG. 3 illustrates a second exemplary embodiment of a consumable item, such as an inkjet cartridge, in which a wireless data link is used for communicating with the memory component. The memory component 114" comprises an integrated circuit 342 which is die bonded and wire bonded to a substrate 340, and then encapsulated in epoxy. A printed circuit antenna 344 is formed on the substrate to receive data and power and to transmit data. When utilized by the consumer, the consumable item 112" with the memory component 114" is mated to a receiving station 310, such as on the carriage of an inkjet printer. The consumable item and receiving station may include other interconnections, such as electrical connections or fluid connections. The receiving station may, for example, be in data communication with a controller 320 to allow print data to be sent to the printheads. In the embodiment of FIG. 3, communication between the controller 320 and the memory component 114" is through a wireless data link 330, which allows reading of the data in the memory component, such as by printer driver software.

Figure 4A:
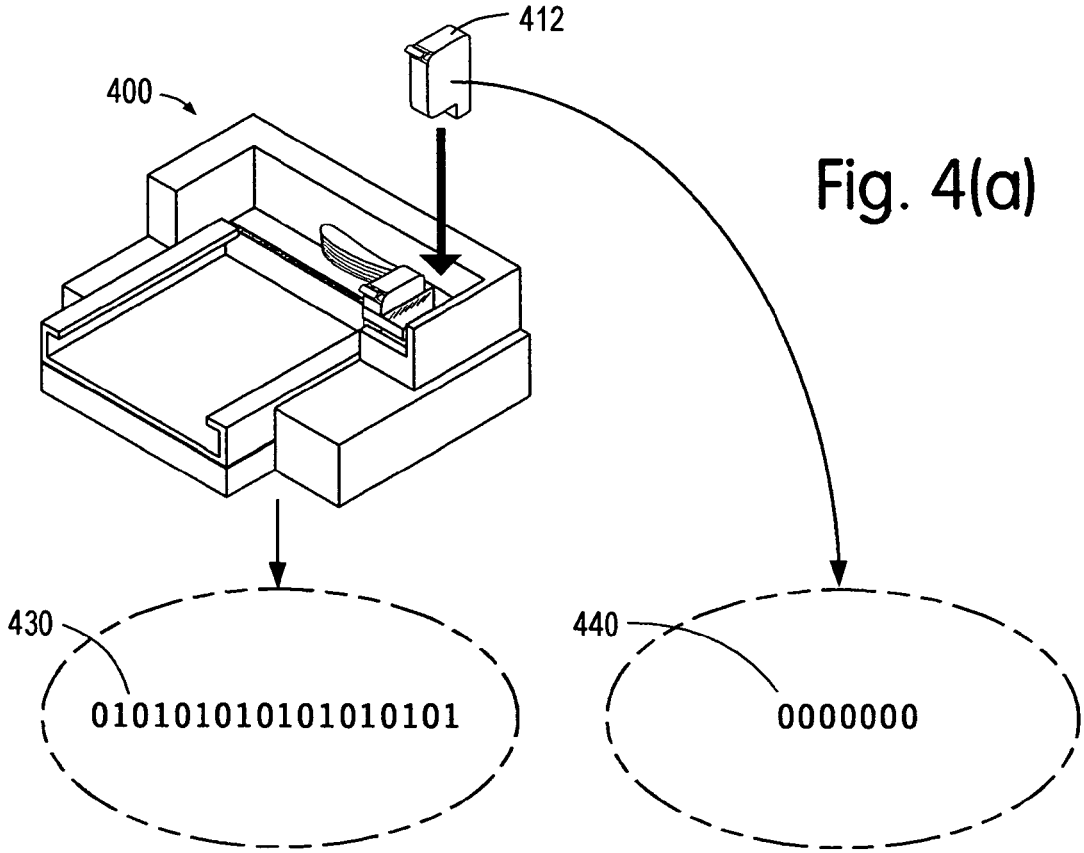
FIGS. 4(*a*) and 4(*b*) schematically illustrate an exemplary embodiment of the invention.
Figure 4B:
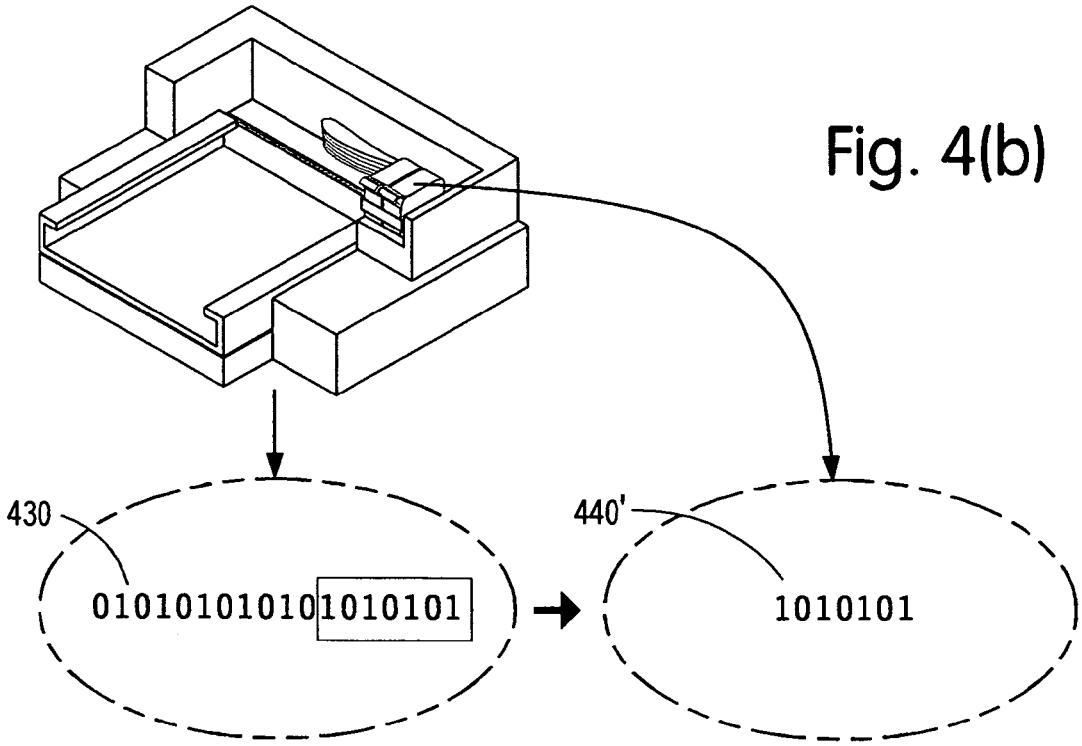

Typical memory components 114' and 114" of FIGS. 2 and 3 include forms of electronic non-volatile memory, such Electrically Erasable Programmable Read-Only-Memory (EEPROM), Read-Only-Memory (ROM) or Programmable Read-Only-Memory (PROM). The exemplary memory components of FIGS. 3 and 4 are illustrative only; other memory components may also be utilized. For example, an integrated single-chip wireless device may used, such as Coil-on-Chip™ technology developed by Hitachi Maxell (not shown). The memory component may also be integral with some other component of the consumable item; for example, memory bits in the form of fusible links (or other memory structures) may be incorporated onto the silicon die of an inkjet printhead.

FIGS. 4(*a*)/4(*b*) and 5(*a*)/5(*b*) schematically illustrate two exemplary embodiments of the invention. In general terms, embodiments of the invention involve modifying non-volatile data fields in the integral memory components of consumable cartridges (and, in some embodiments, data fields in the utilizing device memory) such that the consumable cartridges become compatible with only a small subset of utilizing devices, thereby substantially reducing their potential value to a thief or unauthorized borrower.

In the illustrated exemplary embodiments, effective application of the invention is premised on the assumption that substantially all of the utilizing devices that might potentially utilize a cartridge are configured to "reject" non-compatible cartridges, as discussed below.

FIG. 4(*a*) illustrates a utilizing device 400 and consumable item or cartridge 412 prior to installation of the cartridge, and FIG. 4(*b*) illustrates the device and cartridge after the cartridge has been installed and configured for "theft deterrence". In the exemplary embodiment of FIG. 4(*a*)/4(*b*), the utilizing device includes or has access to non-volatile data 430 that provides information to differentiate the particular device from others, such as, for example, a unique device serial number (which may have been programmed into non-volatile memory of the device during manufacture). The memory component of replaceable consumable cartridge 412 includes a non-volatile theft deterrence ("TD") data field 440 that may be read from and written to by the utilizing device.

Non-volatile TD data field 440 includes a sufficient number of data bits such that a fairly large number of different "keycodes" can be accommodated, as explained below. In the embodiment of FIGS. 4(*a*)/4(*b*), a seven-bit field allows for an initial state and 127 different keycodes. If the cartridge has not previously been configured for theft deterrence (for example, if the cartridge is new), the TD data field contains a code indicating that the cartridge is not configured for theft deterrence, such as, for example, "0000000".

Upon installation of the cartridge (or, alternatively, a decision by the user to configure a previously-installed cartridge for theft deterrence), the utilizing device 400 generates a keycode and writes the keycode to the TD data field 440 of the cartridge 412. The keycode is selected to differentiate the specific utilizing device from other similar utilizing devices; for example, a least-significant portion of the device serial number may be used, as indicated in FIG. 4(*b*). Writing the keycode may involve permanently altering data bits in the cartridge memory device, if the memory is of "write once" type, such a PROM or fusible data bit; or may involve electronically altering data bits, if the memory device is EEPROM.

The keycode may also be generated in other some more complex fashion from data either in the utilizing device's memory or in some manner accessible to the utilizing device, or may be provided from an external source, such as from a connected computer or network, so long as the keycode sufficiently distinguishes the specific device, and can later be recreated or retrieved by the device to "validate" a cartridge.

The effectiveness of theft deterrence is predicated on the assumption that substantially all similar utilizing devices will not accept a TD encoded cartridge from another device. Before permitting use of a cartridge, a utilizing device will validate the cartridge to verify that it does not "belong" to another device that has encoded the cartridge for theft deterrence. If a utilizing device detects a cartridge with a keycode other than the "correct" code, the utilizing device will in some manner reject the cartridge, such as, for example, by issuing prompts to the user to replace the cartridge or by not operating with the cartridge installed.

Assuming a seven-bit TD data field, a TD-enabled cartridge removed from one utilizing device may then has as little as a one-in-127 probability of functioning in another utilizing device, essentially eliminating the incentive for theft.

Figure 5A:
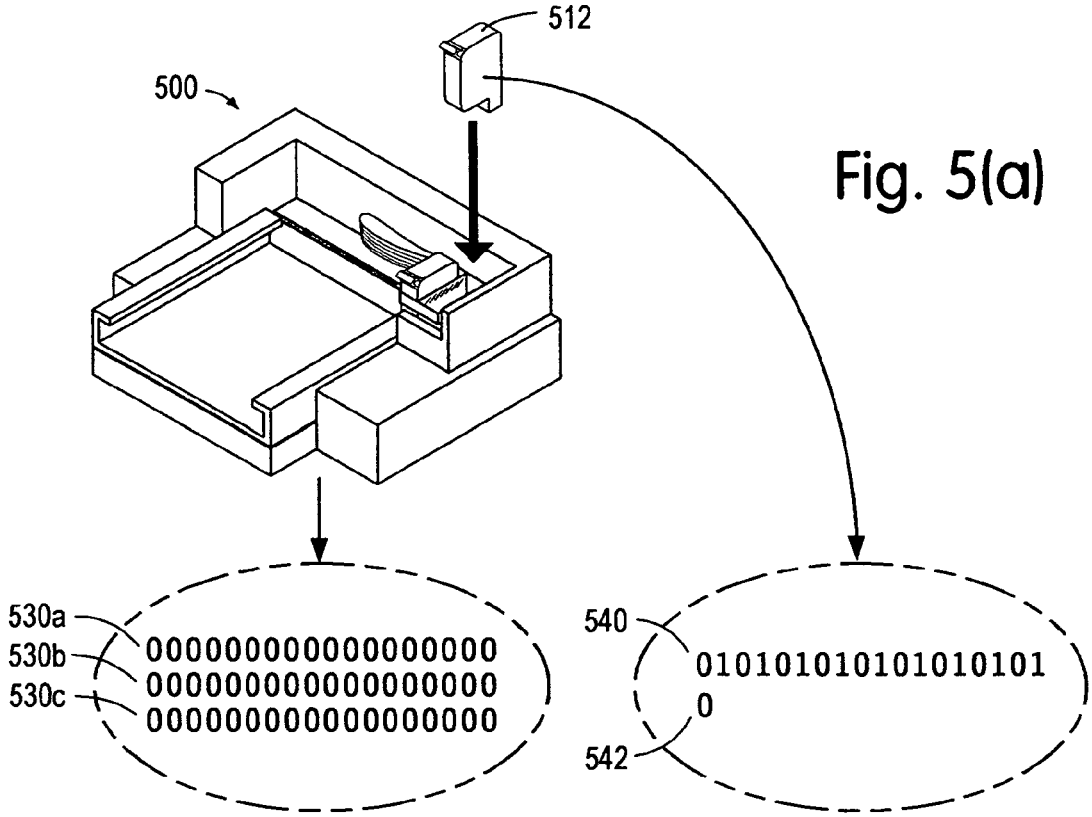
FIGS. 5(*a*) and 5(*b*) schematically illustrate a further exemplary embodiment of the invention.
Figure 5B:
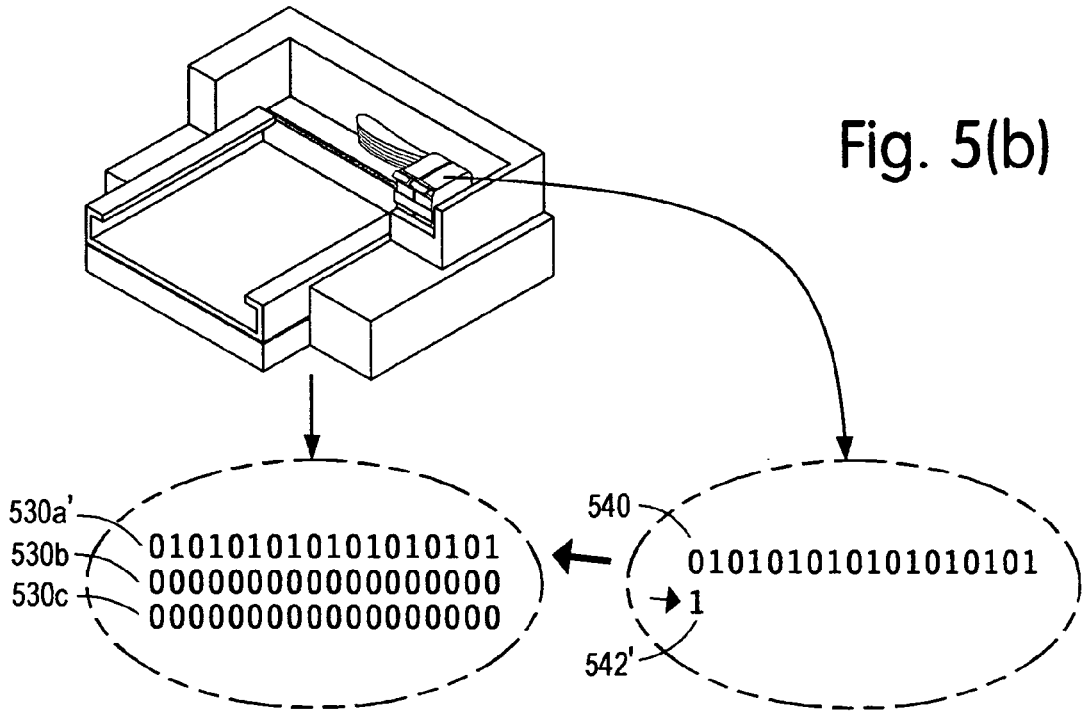

FIGS. 5(*a*)/5(*b*) illustrate a further exemplary embodiment of the invention. This embodiment seeks to minimize the amount of additional memory needed in the cartridge memory device to implement theft deterrence, and assumes that each cartridge is programmed with a unique serial number at the time of manufacture (or some other data, such as date and time codes, that are likely to distinguish the cartridge from other similar cartridges).

As shown in FIG. 5(*a*), the new (or not previously configured) cartridge 512 has in its memory component an identifier 540, such as a serial number, and a theft deterrent flag 542. Within the non-volatile memory of the utilizing device are one or more data fields 530*a*, 530*b*, 530*c*. Upon installation or configuration of the cartridge, FIG. 5(*b*), the identifier from the cartridge is copied to one of the data fields 530*a*' of the utilizing device, and the TD flag in the cartridge is set to "true" or "1". When validating a cartridge, the utilizing device accesses the identifier on the cartridge and compares it to the list of identifiers stored in non-volatile memory; if no match is found, the cartridge is "rejected". The embodiment of FIGS. 5(*a*) and 5(*b*) would thus allow a small number of cartridges to be swapped in and out of the utilizing device, depending on the number of data fields allotted in the device.

Other embodiments will be apparent to those skilled in the art, having in common the modification of a data field or data flag within the memory component of the cartridge, together with data stored either on the consumable or within the utilizing device to identify the cartridge as "belonging" to the utilizing device.

Figure 6:
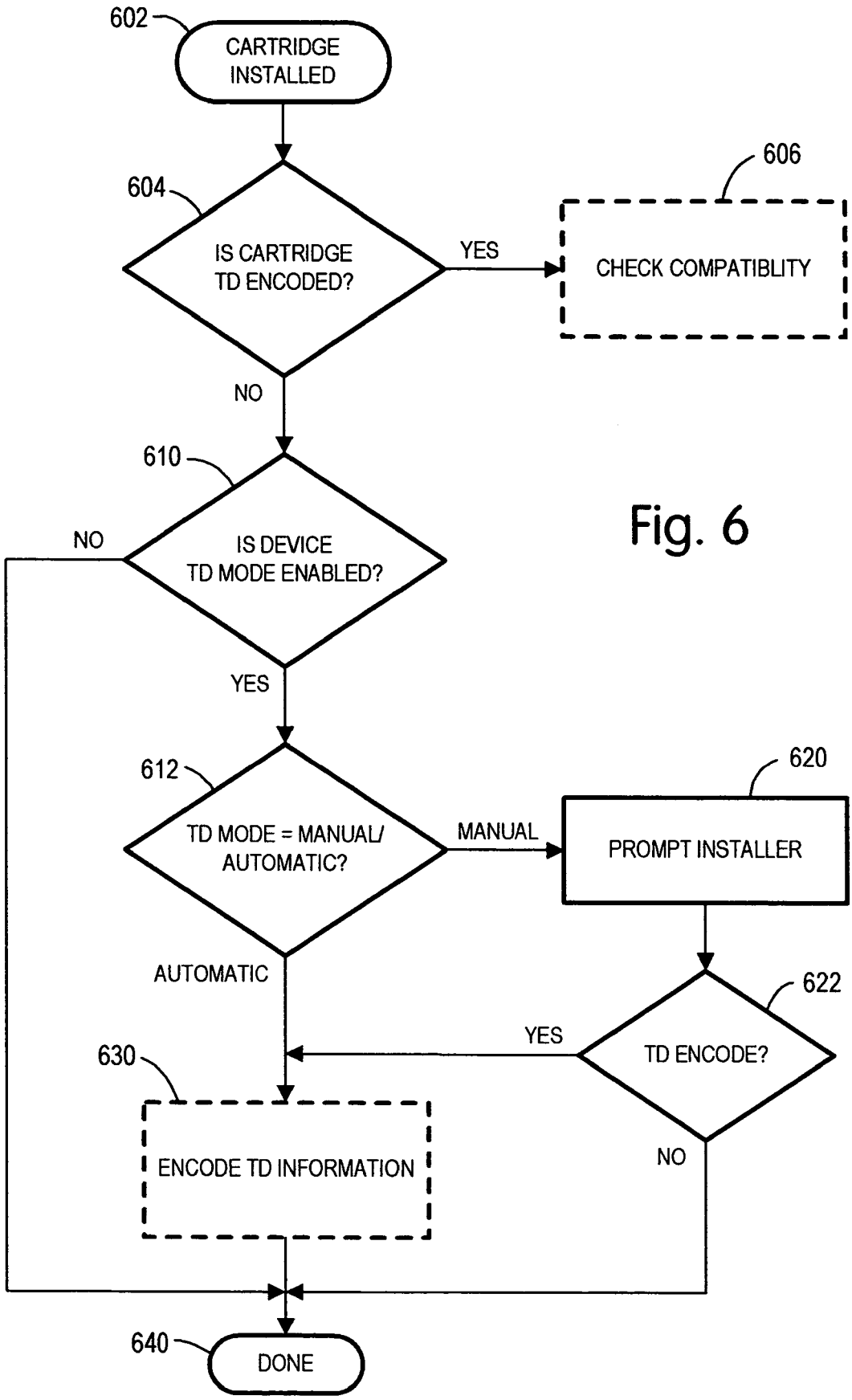
FIG. 6 is a flowchart summarizing exemplary embodiments of the invention.

FIG. 6 is a flowchart summarizing exemplary embodiments of the invention. In the embodiment of FIG. 6, a cartridge is installed 602, and the utilizing device tests the cartridge to determine if the cartridge is "theft deterrent" enabled 604. If "yes", the utilizing device checks if the cartridge is "compatible" 606, in that the cartridge "belongs" to the utilizing device, and either accepts or rejects the cartridge, as discussed below. The test for compatibility is performed by all similar utilizing devices, regardless of whether the user or owner of a particular utilizing device intends to TD encode consumable cartridges, such that cartridges from a TD "enabled" device will have a low probability of working on other devices.

In some embodiments, the use of the theft deterrence feature may be made optional, such that new cartridges are not TD encoded. If the user or owner of the utilizing device wishes to make use of the theft deterrence feature, the theft deterrence mode of the device will at some point have been enabled 610, such as by the user or owner having selected the option from a menu of a driver, such as a printer driver, or otherwise having enabled the mode. In some embodiments, the user or owner may have the option 612 of automatically TD encoding all cartridges installed in the utilizing device, or manually selecting which cartridges to encode. If automatic, the utilizing device will proceed to encode the cartridge 630, as discussed below; if manual, the user or operator will be prompted 620 to decide 622 whether the cartridge should be TD encoded. The utilizing device may then resume normal operation 640.

If the theft deterrence feature is optional on a utilizing device, some form of protection against the feature being disabled may be desirable, such as password protection of the software application that sets the device mode. Permitting only authorized persons to change the mode would secure the device against surreptitious disablement, allowing the owner to place the device in a public setting without having to be concerned about whether the consumable items are being properly encoded.

Although FIG. 6 illustrates an embodiment of the invention initiated with the installation of a cartridge, the tests for compatibility and encoding of a cartridge may be otherwise initiated, such as at "power up" of the device, at the start of an operating sequence, or through user intervention. The "default" mode of the utilizing device may also be to TD encode cartridges; and specific embodiments may dispense with either the manual or automatic encoding options.

Figure 7A:
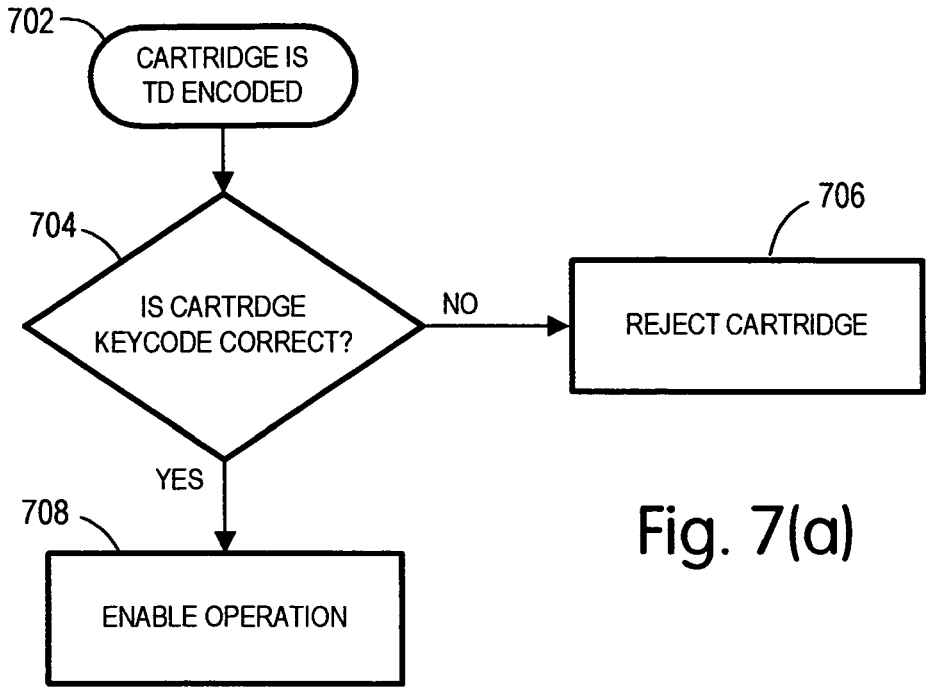
FIG. 7(*a*) is a flowchart illustrating the "check compatibility" steps for an exemplary embodiment of the invention.
Figure 7B:
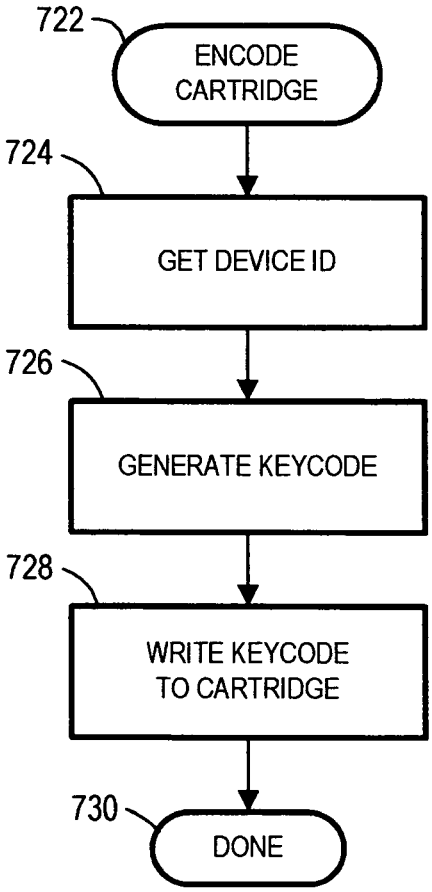

FIG. 7(*a*) is a flowchart illustrating the "check compatibility" steps for an exemplary embodiment of the invention corresponding to FIGS. 4(*a*)/4(*b*). If the cartridge is theft deterrence encoded 702, the utilizing device will examine the keycode stored in the memory component of the device to determine 704 if it matches the distinguishing keycode for the utilizing device. If there is a mismatch, the cartridge is rejected 706. Rejection may entail preventing normal operation of the utilizing device, such as preventing printing by an inkjet printer, and may also include notifying the user in some fashion, such as audible or visible prompts or warning messages. If the keycode is correct, normal operation of the utilizing device proceeds 708.

FIG. 7(*b*) is a flowchart illustrating the "encode TD information" steps for an exemplary embodiment of the invention corresponding to FIGS. 4(*a*)/4(*b*). If the cartridge is to be encoded 722, the utilizing device obtains identifying information 724, which may be derived from the device serial number or from other information that differentiates the device from similar devices. Based on the identifying information, the utilizing device generates a keycode 726, which is then written 728 to the memory component on the cartridge. The utilizing device may then resume normal operation 730.

Figure 8A:
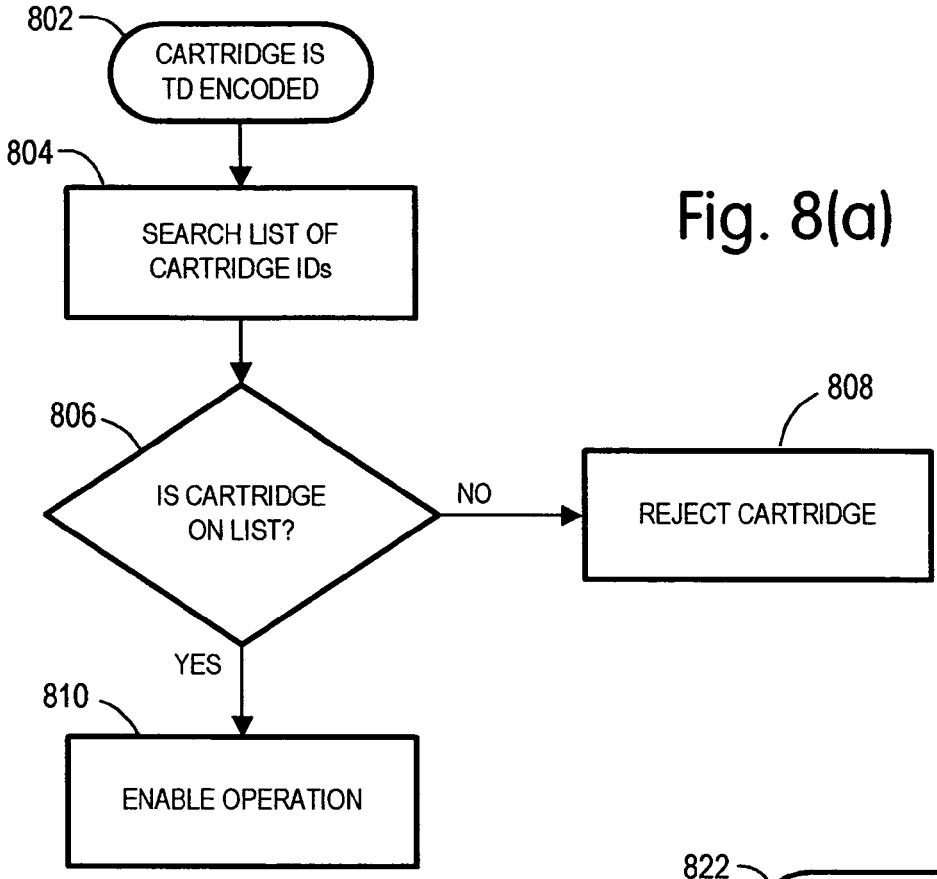
FIG. 8(*a*) is a flowchart illustrating the "check compatibility" steps for a further exemplary embodiment of the invention.
Figure 8B:
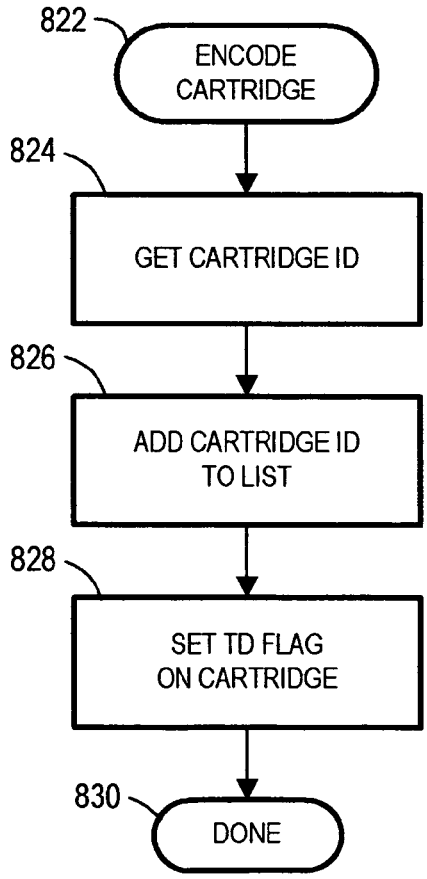

FIG. 8(*a*) is a flowchart illustrating the "check compatibility" steps for an exemplary embodiment of the invention corresponding to FIGS. 5(*a*)/5(*b*). If the cartridge is theft deterrence encoded 802, the utilizing device will examine compares 804 identifying information in the cartridge memory, such as a serial number, against a list of accepted cartridges maintained by the utilizing device. The list of cartridges may, for example, be stored in the non-volatile memory of the device. If the cartridge is not on the list 806, the cartridge is rejected; if it is on the list, normal operation of the device is enabled 801.

FIG. 8(*b*) is a flowchart illustrating the "encode TD information" steps for an exemplary embodiment of the invention corresponding to FIGS. 5(*a*)/5(*b*). If the cartridge is to be encoded 822, the utilizing device gets the cartridge identifying information 824 from the cartridge memory component, which may include a serial number stored at the time of manufacture, or other information such as date and time codes. The utilizing device adds the identifying information to a list of acceptable cartridges 826. The list could include only a single entry for the present cartridge, or could include additional information, allowing some flexibility for the swapping of cartridges in and out of the device. If the list is of a fixed length and includes multiple cartridges, the utilizing device may need to remove an older entry on the list to allow the new cartridge to be added, such as by tracking the time intervals since each cartridge on the list was last installed, and removing the oldest, or utilize some other strategy to maintain the list. The utilizing device also sets the theft deterrent flag on the cartridge 828, and resumes normal operation 830.

Many variations of the above exemplary embodiments are possible without departing from the basic concepts of the invention. For example, some steps indicated as being done by utilizing device could similarly be done externally, such as by a print driver resident on a computer; and steps may be performed in a different order or at different times than indicated above.

In some settings, where a small community of utilizing devices exists (such as, for example, inkjet printers in an office or a public library), it may be desirable to encode all the consumable items such that they may be freely swapped between "inside" devices, while still having theft deterrence with respect to use in "outside" devices. Embodiments of the invention may be extended to such situations by, for example, providing mechanisms to securely set the keycodes of multiple computers (such as by an authorized user reprogramming the non-volatile memory of the utilizing devices to contain a specific keycode common to all the utilizing devices of the community), or by maintaining a list of consumable identifying codes on computer network accessible to all the utilizing devices, with appropriate safeguards to prevent unauthorized discovery or use, as known in the art.

A potential drawback to theft deterrence is the situation where a utilizing device is somehow reinitialized, and in some manner "forgets" its own identity. For example, an inkjet printer may on very rare occasions encounter a series of events causing the internal non-volatile memory to reset, which could mean the loss of either the distinguishing information utilized to generate a keycode, or the list of approved cartridges. In these rare occurrences it is contemplated that the utilizing device will default to a mode of accepting all cartridges, whether or not the cartridges have been encoded.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A method of deterring theft of consumable items intended for installation in a utilizing device, each replaceable consumable item having an integral memory component, each memory component including non-volatile memory pre-programmed with a distinctive keycode substantially distinguishing each replaceable consumable item from other replaceable consumable items; each non-volatile memory further having a flag settable to designate theft deterrence; the method comprising:

installing a consumable item into the utilizing device;

determining if the flag of the installed consumable item is set to designate theft deterrence and, if it is determined that the flag is set to designate theft deterrence, then:

reading the keycode from the installed consumable item;

comparing the keycode from the installed consumable item to a list of accepted consumable items, and, if the keycode from the installed consumable item is not on the list, rejecting the installed consumable item; and determining if the flag of the installed consumable item is not set to designate theft deterrence and, if it is determined that the flag is not set to designate theft deterrence, then:

copying the keycode from the installed consumable item to the list identifying accepted consumable items, and setting the flag to designate theft deterrence.

2. The method of deterring theft of consumable items of claim 1, wherein the steps of determining, reading, comparing, rejecting, copying, and setting are performed by a controller in the utilizing device.

3. The method of deterring theft of consumable items of claim 2, wherein the list of accepted consumable items is stored in non-volatile memory within the utilizing device.

4. The method of deterring theft of consumable items of claim 1, wherein the utilizing device comprises a printer and the installed consumable item comprises a printer cartridge.

5. The method of deterring theft of consumable items of claim 4, wherein the printer comprises an inkjet printer and the printer cartridge comprises an ink cartridge.

6. The method of deterring theft of consumable items of claim 4, wherein the printer comprises a laser printer and the printer cartridge comprise a toner cartridge.

7. The method of deterring theft of consumable items of claim 1, wherein the step of rejecting the installed consumable item comprises issuing prompts to a user to replace the installed consumable item.

8. The method of deterring theft of consumable items of claim 1, wherein the step of rejecting the installed consumable item comprises the utilizing device not operating.

9. A method of deterring theft of printer cartridges, each printer cartridge having an integral memory component, each memory component including non-volatile memory pre-programmed with a distinctive keycode substantially distinguishing each printer cartridge from other printer cartridges; each non-volatile memory further having a flag settable to designate theft deterrence; the method comprising:

installing a print cartridge into the a printer;

determining if the flag of the installed printer cartridge is set to designate theft deterrence and, if the flag is set to designate theft deterrence, then:

reading the keycode from the installed printer cartridge;

comparing the keycode from the installed printer cartridge to a list of accepted printer cartridges, and, if the keycode from the installed printer cartridge is not on the list, rejecting the installed printer cartridge; and determining if the flag of the installed printer cartridge is not set to designate theft deterrence and, if the flag is not set to designate theft deterrence, then:

copying the keycode from the installed consumable item to the list of accepted printer cartridges, and setting the flag to designate theft deterrence.

10. The method of deterring theft of printer cartridges of claim 9, wherein the steps of determining, reading, comparing, rejecting, copying, and setting are performed by a controller in the printer.

11. The method of deterring theft of printer cartridges of claim 10, wherein the list of accepted printer cartridges is stored in non-volatile memory within the printer.

12. The method of deterring theft of printer cartridges of claim 9, wherein the step of rejecting the installed consumable item comprises issuing prompts to a user to replace the installed printer cartridge.

13. The method of deterring theft of printer cartridges of claim 9, wherein the step of rejecting the installed printer cartridge comprises the preventing the printer from printing.

* * * * *

UNITED STATES PATENT AND TRADEMARK OFFICE

CERTIFICATE OF CORRECTION

PATENT NO. : 7,399,047 B2
APPLICATION NO. : 10/834450
DATED : July 15, 2008
INVENTOR(S) : Jefferson P. Ward et al.

It is certified that error appears in the above-identified patent and that said Letters Patent is hereby corrected as shown below:

In column 2, line 59, delete “carnage” and insert -- carriage --, therefor.

Signed and Sealed this

Second Day of December, 2008

JON W. DUDAS
*Director of the United States Patent and Trademark Office*